United States Patent [19]

Hall

[11] 4,428,207

[45] Jan. 31, 1984

[54] DEHUMIDIFIER

[75] Inventor: William B. Hall, Lakeworth, Fla.

[73] Assignee: Martin Industries, Inc., Florence, Ala.

[21] Appl. No.: 307,430

[22] Filed: Oct. 9, 1981

[51] Int. Cl.[3] ..... F25D 17/04; G05D 22/00

[52] U.S. Cl. ..... 62/176.1; 62/291; 236/44 R

[58] Field of Search ..... 62/176 R, 93, 288, 291, 62/285, 176 E, 128; 236/44 R, 44 A, 44 C; 165/21

[56] References Cited

U.S. PATENT DOCUMENTS

| | | | |
|---|---|---|---|
| 2,146,483 | 2/1939 | Philipp | 62/176 E |
| 2,153,696 | 4/1939 | Philipp | 62/176 E |
| 2,337,518 | 12/1943 | Young et al. | 62/291 X |
| 3,035,418 | 5/1962 | Wright | 62/176 R |
| 3,496,731 | 2/1970 | Sholtes | 62/176 R |
| 4,151,726 | 5/1979 | Schlueter | 62/285 |

*Primary Examiner*—Albert J. Makay
*Assistant Examiner*—Harry Tanner
*Attorney, Agent, or Firm*—C. A. Phillips

[57] ABSTRACT

A dehumidifier wherein an evaporator, condenser and fan are positioned vertically, from top to bottom, in this order, between an upper air entrance and a lower exit of the dehumidifier.

1 Claim, 3 Drawing Figures

DEHUMIDIFIER

TECHNICAL FIELD

This invention relates to humidifiers suitable for portable placement within a building.

BACKGROUND ART

The conventional form of manufacture of room-type, portable, dehumidifiers is to place the elements of the dehumidifier: evaporator, condenser and fan in a horizontal line, with an entrance to the dehumidifier on one end or side of its cabinet and an exit on the opposite side or end. This configuration has been found to have at least two difficulties. One, there is a stratification of air bearing moisture in a room wherein the higher percentage content of moisture in the air is in upper, warmer, air. Thus, with air being drawn into a dehumidifier in a horizontal air flow, relatively low in a room, less moisture is operated on by the dehumdifier. Second, by this horizontal arrangement of components, inherently, the moisture or condensate container which receives moisture from the evaporator must be short of height, and typically such container has a large open top. As a result, such a container can seldom be emptied without spillage, if it is at all near capacity.

It is the object of this invention to overcome these difficulties and to provide an improved dehumidifier.

DISCLOSURE OF THE INVENTION

In accordance with this invention, an air entrance for a dehumidifier is in its top, and its exit is around its bottom. The evaporator and condenser, in this order, would be arranged for vertical, downward, flow through them. The evaporator is positioned with a tilt or not less than approximately 18°, and thereby a pan positioned under the lower tilted end of the evaporator catches liquid running down the coils of the evaporator, this angle being such that liquid will not directly drop off the evaporator until it reaches the end where there is the pan. Air through the humidifier is moved through it by a fan, which typically is positioned under the condenser.

DETAILED DESCRIPTION OF THE DRAWINGS

Figure 1:
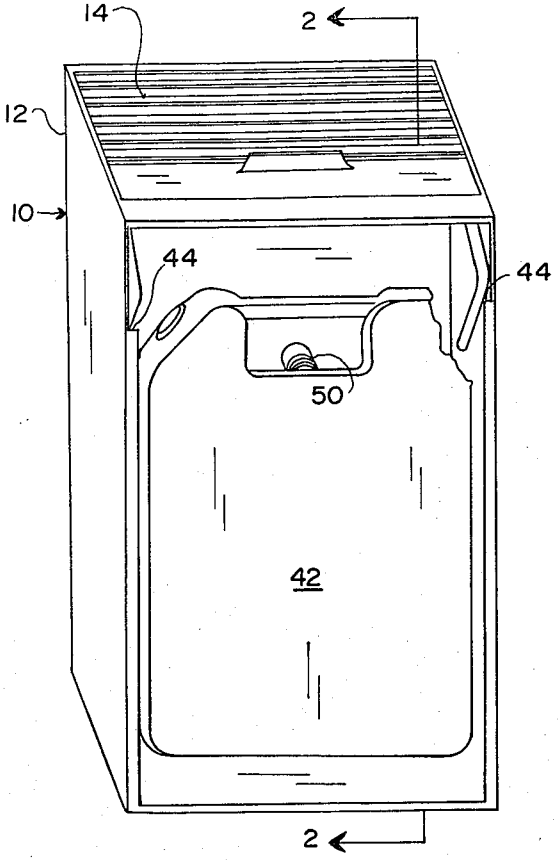
FIG. 1 is a pictorial view of the embodiment of the invention as shown from the rear.

Referring to the drawings, a dehumidifier 10 is constructed with its components housed in a portable cabinet 12 typically having wheels (not shown) for movement within a room. An air inlet is formed by grille 14 positioned in the top of cabinet 12, and an exhaust outlet is formed by openings 16 positioned around the bottom the cabinet. A conventional refrigerant evaporator 18 is supported by a racket (not shown) near the top of cabinet 12, it being oriented approximately as shown, with its general plane of construction being at an angle typically in excess of 18°, whereby moisture falling on tubes 20 of evaporator 18 will run down, to the left, and drop off only when the water reaches approximate point 22 near the end of evaporator 18. A pan or tray 24 attaches to cabinet 12 and partially surrounds the left-hand region of evaporator 18 insuring that liquid, or condensate, from evaporator 18 will be caught in tray 24. To maintain compactness, the next element of the system, condenser 26, is supported via bracket 28 on cabinet 12 at a similar direction of tilt to that of evaporator 18. Condensor 26 is a conventional refrigerant condenser and functions to condense refrigerant applied under pressure from compressor 30. Fan 32 is supported by bracket 35 on condenser 26, and it draws air downward through the dehumidifier. Fan motor 34 drives fan blade 36.

Compressor 30 is positioned in the bottom spaces of cabinet 12 and is a conventional refrigerant compressor, supplying refrigerant through line 38 to condenser 26. Condenser 26 condenses gaseous refrigerant to a liquid and gives off heat resulting from this process. Capillary tube 40 couples between condenser 26 and evaporator 18 and effects a reduction in pressure at its outlet, whereby the liquid refrigerant is caused to evaporate in evaporator 18. The resulting chillded surface of evaporator 18 effects the condensing of moisture in the air drawn through it.

Figure 3:
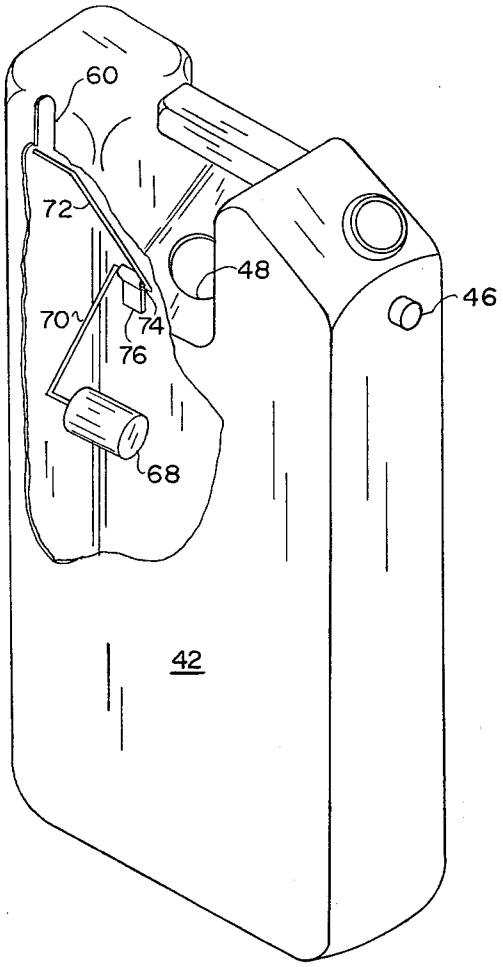
FIG. 3 is a pictorial view, partially broken away, of a condensate container.
Figure 2:
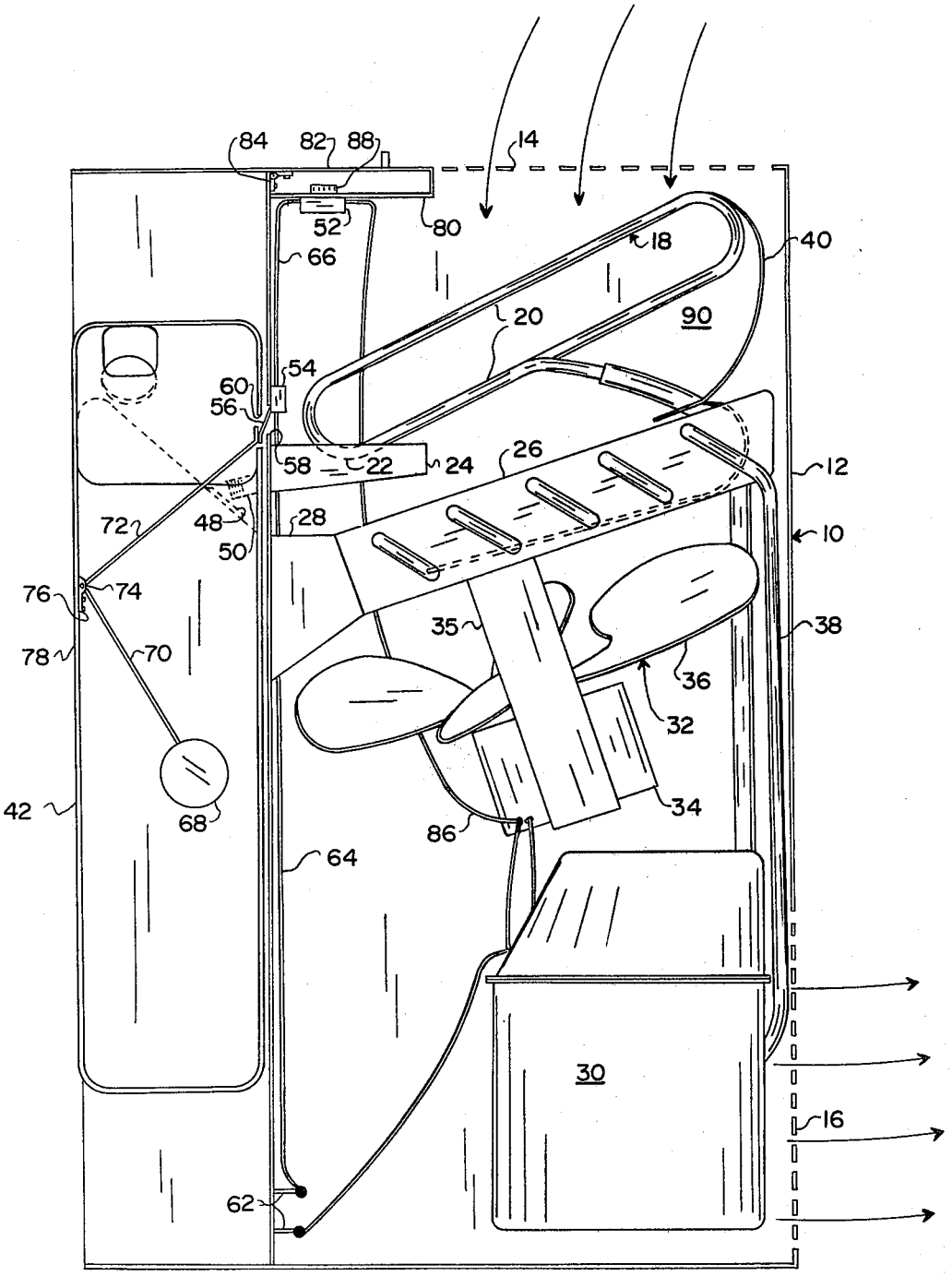
FIG. 2 is a sectional view of FIG. 1 as seen along line 2—2 of FIG. 1.

A liquid container 42 is supported on the rear side of cabinet 12 as particularly shown in FIG. 1. A pair of grooved receptacles 44 on cabinet 12 receive a pair of knobs 46 (FIG. 3) on opposite sides of container 42, enabling container 42 to be readily removed and installed. As installed, an opening 48 in container 42 aligns with a drain spout 50 from tray 24, enabling condensate in tray 24 to run freely into container 42.

As a particular feature of this invention, operating power to the system, that is, power to energize fan motor 34 and compressor 30, is supplied through both a conventional humidistat 52 and a normally open switch 54, the latter mounted on the rear of cabinet 12. Switch 54 has an operating arm 56 which extends through aperture 58 in cabinet 12 and aperture 60 in container 42. When arm 56 is not engaged, switch 54 opens the circuit from power input terminals 62, through leads 64 and 66, to humidistat 52. Container 42 has mounted inside a float 68 which is attached to an arm 70, in turn connected to arm 72, which engages arm 56 of switch 54. Arms 70 and 72 intersect at point 74 where they are pivotally mounted by bracket 76 to a wall 78 of container 42. With no liquid present in container 42 (or less than a selected level), float 68 would react to gravity and arms 70 and 72 would cause a force from left to right to be applied to arm 56 of switch 54 to close switch 54 and signal that container 42 either had no liquid in it or was not filled to a selected capacity. It is to be appreciated that by appropriate arrangement of the length of arms 70 and 72 and its pivot point 74 that differing fill points could be selected before action of switch 54 is effected.

Humidistat 52 is mounted on a shelf 80 under a door 82, held by hinge 84. Humidistat 52 is conventional and operates to close an internal switch connected in circuit with power leads 86 and 66 to close a circuit which powers both compressor 30 and fan motor 34 when the humidity level rises above a selected level as chosen by the position of knob 88 of humidistat 52.

When this occurs, air is drawn down through grille 14 and through evaporator 18. Evaporator 18, having a cool surface due to the evaporation of refrigerant therein, condenses moisture on its surface, and this moisture runs down tubes 20 of the evaporator into tray 24 and from tray 24 the liquid runs into container 42, as described. The thus cooled air passes through a plenum region 90 below evaporator 18 through condenser 26 where the cool air assists in the condensing operation of condenser 26, which is, of course, to condense the refrigerant.

By virtue of the drawing of upper air from a room downward into the dehumidifier, the effectiveness of dehumidification is substantially enhanced. By the removable container and automatic shut-off of the system, overflows and spillage are essentially eliminated as problems.

I claim:

1. A dehumidifier comprising:

a cabinet having an upper, vertical entrance opening and a lower, exit opening;

a refrigerant compressor positioned in a generally lower region of said cabinet;

a refrigerant condenser comprising a heat exchanger mounted in a region of said cabinet above said compressor and extending across said cabinet and oriented to intercept air flow from said entrance to said exit;

a refrigerant evaporator positioned above said condenser in said cabinet having a tilted plane of configuration a condensate pan supported by said cabinet and having a drain, said pan having an upper opening surrounding a lower tilted side of said evaporator, whereby moisture forming on said evaporator flows downward along said evaporator to said pan;

refrigerant connections interconnecting said compressor, condenser and evaporator comprising a compressed fluid line from said compressor to said condenser, a high-to-low pressure coupler between said condenser and evaporator, and a return line from said evaporator to said compressor;

an electrically powered fan positioned below said condenser in said cabinet and oriented and powered to rotate in a direction, to draw air downward from said entrance, through said evaporator and condenser, and forcing the air outward through said lower exit;

humidity sensing means including switching means for turning said fan, motor and compressor "on" responsive to a selected level of environmental humidity;

a condensate container removably supported on said cabinet and having an opening aligned with said drain to receive condensate from said pan;

a normally "off" switch mounted on said cabinet and adjacent to said container when said container is supported on said cabinet;

a float and lever coupled to said float, said lever being pivotally supported by said container and having an arm operably coupled to said switch when said container is supported on said cabinet and operating said switch to an "on" state when said container is in less than a selected liquid full state; and said switch being coupled in circuit between said humidity sensing means and said motor of said fan and said compressor, and thereby enabling the application of power only when said container is in place on said cabinet and said container is in less than a selected liquid full state.

* * * * *